United States Patent [19]

Dutt et al.

[11] Patent Number: 4,700,867

[45] Date of Patent: Oct. 20, 1987

[54] SLEEVED CONTAINER AND CLOSURE ASSEMBLY

[75] Inventors: Herbert V. Dutt, Sarasota; Dixie L. Weir, Brandenton, both of Fla.

[73] Assignee: Sun Coast Plastics, Inc., Sarasota, Fla.

[21] Appl. No.: 832,804

[22] Filed: Feb. 25, 1986

[51] Int. Cl.[4] ..... B65D 25/14

[52] U.S. Cl. ..... 220/410; 220/408; 220/461; 220/462

[58] Field of Search ..... 220/404, 410, 403, 408, 220/460, 461, 462

[56] References Cited

U.S. PATENT DOCUMENTS

| | | | |
|---|---|---|---|
| 4,650 | 11/1871 | Camp . | |
| 282,844 | 8/1883 | Cherry . | |
| 298,393 | 5/1884 | Mason et al. . | |
| 2,110,612 | 3/1936 | Skinner et al. . | |
| 2,535,847 | 9/1945 | Fukal . | |
| 2,912,136 | 11/1959 | Redmond | 220/404 |
| 3,052,371 | 9/1962 | VanBemmelen | 220/404 |
| 3,058,642 | 11/1958 | Hester . | |
| 3,445,031 | 5/1969 | Dubois | 220/404 |
| 3,458,079 | 7/1969 | Gasbarra | 220/307 |
| 3,487,989 | 1/1968 | Rausing et al. . | |
| 3,620,399 | 11/1971 | Rapeaund | 220/404 |
| 3,662,944 | 5/1972 | Joosten, Sr. . | |
| 3,739,827 | 6/1973 | Sandel | 220/410 |
| 3,799,423 | 3/1974 | Cvacho . | |
| 3,871,568 | 3/1975 | Bahler . | |
| 4,094,432 | 6/1978 | Zelbert | 220/404 |
| 4,241,864 | 12/1980 | Kessler . | |
| 4,299,350 | 11/1981 | Woerz . | |
| 4,459,793 | 7/1984 | Zenger | 220/404 |
| 4,466,553 | 8/1984 | Zenger . | |

*Primary Examiner*—George E. Lowrance
*Attorney, Agent, or Firm*—Jones, Tullar & Cooper

[57] ABSTRACT

An inner flexible container is formed with integral sidewalls and a base. A flange is provided at the upper portion of the container and receives the upper portion of a sleeve of paperboard or cardboard that is dimensioned to slide over the inner flexible container. A snap fit closure is applied to the interleaved flexible container's upper flange and outer sleeve and is held in place through the cooperation of interacting tongue and groove and bead and recess sets on the closure and container flange, as well as wedge rings and a locking lip on the flange and closure, respectively. The sleeved container is similar in appearance to conventional frozen juice concentrate containers yet functions in a far superior fashion.

9 Claims, 5 Drawing Figures

SLEEVED CONTAINER AND CLOSURE ASSEMBLY

FIELD OF THE INVENTION

The present invention is directed generally to a container and closure assembly. More particularly, the present invention is directed to a sleeved container and cooperating closure assembly. Most specifically, the present invention is directed to a sleeved container and snap fit plastic closure assembly. The sleeved container includes an inner plastic container, or liner having an integral base and an outwardly flanged upper rim. A pasteboard, cardboard, or similar cylindrical sleeve is positioned about the container with the upper portion of the sleeve being positioned between an upper side wall of the container and a flange web of the downwardly facing container flange. A plastic closure top, which has a circumferential clamping channel, is snap fit down over the composite container formed by the liner and sleeve. The closure top may be further provided with an easy open, pull out center cover disk. The sleeved container and closure assembly is particularly suitable, but not limited to, use with food and beverage products such as frozen juice concentrates and retains the feel and appearance of traditional containers.

DESCRIPTION OF THE PRIOR ART

Frozen concentrates for use in preparing beverages such as orange and grapefruit juice have been available for a number of years. These concentrates are typically sold in small, paper or pasteboard containers or cans which are closed at either end with metal end pieces. One end, which is designated as the bottom, has a metal closure that is crimped to the pasteboard or paper cylinder in a generally permanent manner. The upper closure is also conventionally primarily metal and includes a circumferential plastic pull strip or band. The consumer first locates the free end of the plastic strip, then pulls it while simultaneously rotating the container until the band has been stripped from the entire circumference of the container. He then attempts to remove the upper metal closure without spilling the contents of the can.

Containers of this type are quite expensive and time consuming to fabricate. A pasteboard or paper cylinder is formed with an inner coating so that the package's contents will not soak through the paper and so that the paper will not contaminate the frozen juice concentrate. This cylinder must then have the bottom metal closure attached and then may be filled. After filling, the container has its upper lid and opening band added. This multi-step process is quite expensive and time consuming. Further, the integrity of the seals is not always perfect thus allowing leakage of the contents of the cans resulting in an unattractive and sticky container.

From the time the frozen drink concentrate cans leave the filling plant until the time they are used by the consumer, they should remain frozen. This often does not happen so that the container may be subjected to one or more cycles of freezing and thawing. This is apt to cause the pasteboard or paper to become soggy. There is also the possibility that the container will be deformed during shipping and handling. Both temperature fluctuations and transit or handling damage may adversely affect the integrity of the pasteboard and its interior coating. Exterior deterioration makes the container unattractive and reduces its sales appeal. Interior coating damage is apt to lead to juice concentrate contamination and an off taste.

The prior art juice concentrate container often makes it difficult to remove the concentrate. Once the band has been pulled and the lid has been removed, squeezing the pasteboard or paper sidewalls to force the contents out, often merely deforms the container sufficiently to make it difficult to remove the concentrate. The inner coating is often not of a type that will allow the contents to easily slide out, so the consumer must resort to the use of a scoop or knife to dislodge the can'contents. This maneuver is apt to result in spills or partial loss of the contents of the cans.

It will thus be apparent that the prior art pasteboard or paper and metal frozen juice concentrate cans have a number of substantial disadvantages. They do however have two substantial attributes which have made packers and merchants reluctant to abandon them. They have both a feel and an appearance that the consumer is used to. The feel of the paperboard container is the type that the purchaser expects, and the ability of the paper or cardboard to accept coloring and printing is difficult to duplicate in other materials. Thus the need exists for a container and closure assembly which overcomes the problems inherent with the prior art devices while maintaining the feel and appearance of these prior devices. The sleeved container and closure assembly of the present invention satisfies these requirements.

SUMMARY OF THE INVENTION

It is an object of the present invention to provide a sleeved container and closure assembly.

Another object of the present invention is to provide a sleeved container assembly including a plastic inner container.

A further object of the invention is to provide a sleeved container assembly having a pasteboard or cardboard outer sleeve.

Yet another object of the present invention is to provide a sleeved container and closure assembly utilizing a plastic, snap fit closure.

Still a further object of the present invention is to provide a sleeved container and closure assembly that is stackable.

Even yet another object of the present invention is to provide a sleeved container and closure assembly having a plastic inner container with an integral base and a flanged rim.

Yet still a further object of the present invention is to provide a sleeved container and closure assembly utilizing a plastic closure which requires no adhesive or crimping for attachment.

As will be set forth in greater detail in the description of the preferred embodiment, the sleeved container and closure assembly in accordance with the present invention utilizes a plastic, open mouthed inner container which is preferably formed of polyethylene or polypropylene. This inner container is generally in the form of a hollow cylinder which includes an integral base or bottom and has an outwardly and downwardly rolled flange or rim at its open mouth. A cylindrical sleeve of pasteboard, cardboard, or paper or the like is positionable about the exterior of the polypropylene container. The upper end of the cardboard sleeve is positionable within the rim or flange of the container. Once the sleeve has been placed about the container, a plastic snap-on closure is applied to the composite container to complete the assembly. The plastic closure may include an easy opening top and has a downwardly directed circumferential clamping channel or rim. This rim is shaped to cooperate with the flange on the open mouth of the plastic container and to compress the free end of the container flange inwardly against the cardboard sleeve. Once the snap on top closure has been attached to the container, it forms a positive, secure closure that is not subject to leakage or detachment.

The sleeved container and closure assembly of the present invention provides an inert, flexible inner container for the juice concentrate or other material to be packaged. The polyethylene, polypropylene, or similar material of which the inner container is made is inert, is not subject to deterioration during freeze and thaw cycles, and will not impart any taste or odor to the contents. The container is formed with its integral bottom and upper flange in any known molding process. Insertion of the container into the cardboard sleeve is quickly and easily accomplished as is placement of the plastic closure over the inner container and sandwiched outer sleeve. This is far more simple and inexpensive than the prior art metal closures which required various crimping assemblies and, in some instances, the use of sealants or adhesives. No expensive and complex crimping machines are required to close the sleeved container and closure assembly of the present invention. Similarly, adhesives are not required to attach the closure to the container.

The flexible plastic container will not crack or break during possible rough handling and shippage. Thus the frozen juice will not leak and the containers do not become sticky. Additionally, since there is no leakage, the cardboard or pasteboard sleeves do not deteriorate and become unattractive. The flexible plastic container also presents a smooth surface to the frozen juice concentrate or other contents so that they are quite readily removable. Further, the plastic container will return to its original shape when deformed. This provides a package that is pleasing in appearance in addition to being more convenient that the prior art devices.

The sleeved container and closure assembly in accordance with the present invention, since it utilizes a cardboard or paperboard sleeve, retains the outward feel and appearance of the prior art devices. The feel and appearance created by the cardboard sleeve makes the package acceptable to consumers and does not make the printing costs excessive. The consumer sees a package that is generally the same as what he has been purchasing and he is therefore more apt to accept the new sleeved container and closure assembly of the present invention.

The sleeved container and closure assembly of the present invention is less expensive to make and seal than the prior art devices, is easily and securely closed without using crimping tools or adhesives, and is inert and resilient. It protects the product yet affords easy access to it. In overall feel and appearance, it is quite similar to the prior art devices and thus is apt to be readily acceptable to consumers. It presents a cleaner, neater, more useable, less complex container than the prior art devices at a reduced cost.

BRIEF DESCRIPTION OF THE DRAWINGS

While the novel features of the sleeved container and closure assembly in accordance with the present invention are set forth with particularity in the appended claims, a full and complete understanding of the invention may be had with reference to the detailed description of the preferred embodiment, as is set forth subsequently, and as illustrated in the accompanying drawing in which:

DESCRIPTION OF THE PREFERRED EMBODIMENT

Figure 1:
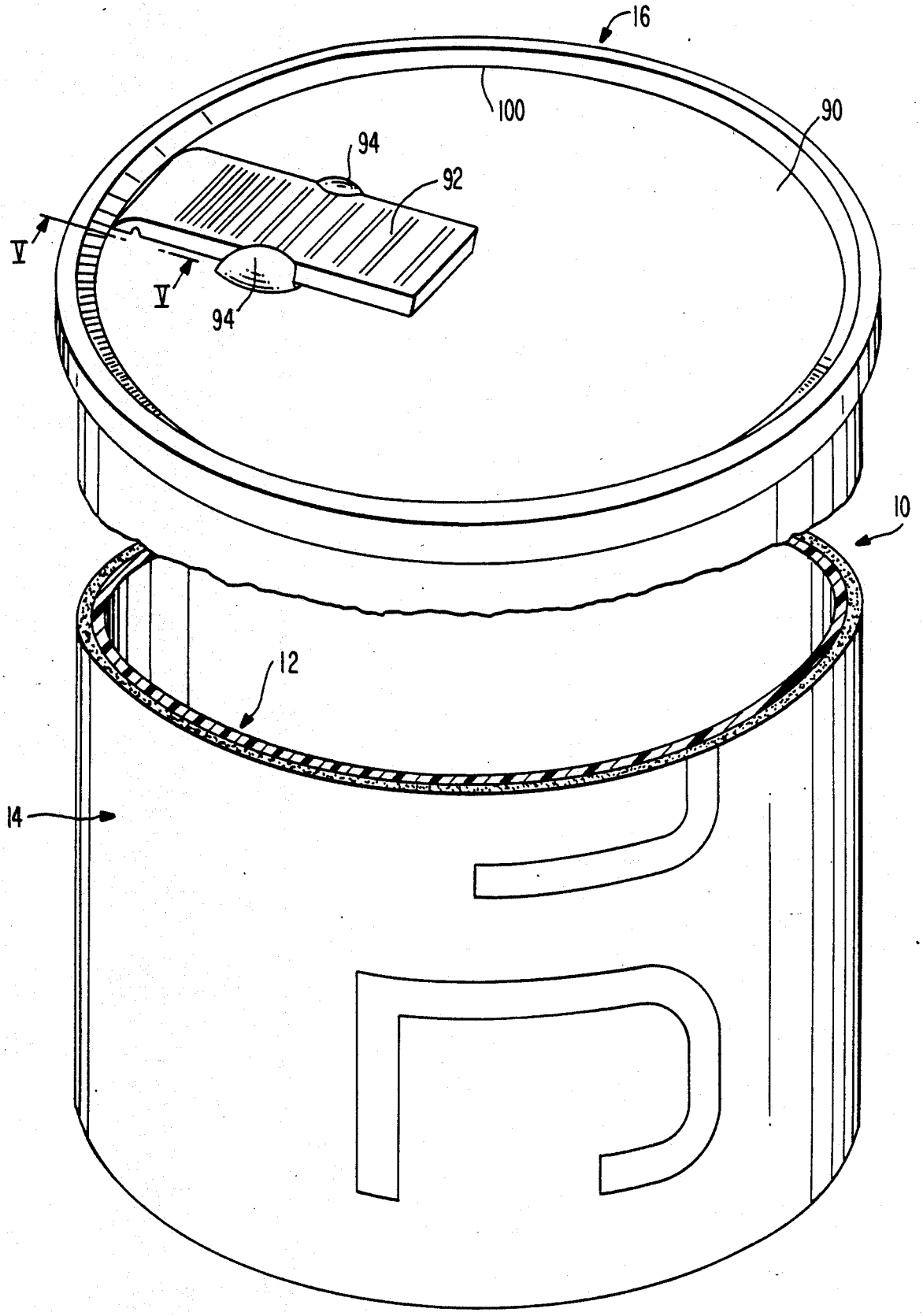
FIG. 1 is a front perspective view of the sleeved container and closure assembly of the present invention with the container being foreshortened.

Turning initially to FIG. 1, these may be seen a preferred embodiment of a sleeved container and closure assembly in accordance with the present invention generally at 10. Assembly 10 is comprised generally of an inner plastic container 12, an outer surrounding cylindrical sleeve 14, and a snap-on, easy opening plastic closure or lid 16. In the preferred embodiment, inner container 12 is formed by an appropriate molding procedure from a suitable inert, flexible material such as polypropylene. While inner container 12 will be referred to as plastic such as polyethylene or polypropylene, it will be understood that inner container 12 is not so limited and could be formed from a wide range of materials, depending on the service for which the container assembly 10 is intended. In a similar manner, outer cylindrical sleeve 14 is, in the preferred embodiment, formed of paperboard, cardboard, or chipboard or the like. Again, the specific material used could be varied in response to end use requirements. Finally, the closure cap or lid 16 is, in the preferred embodiment, also formed from a plastic material such as polyethylene or polypropylene having the appropriate rigidity and durability for the intended use. However, any number of materials could be used.

Figure 2:
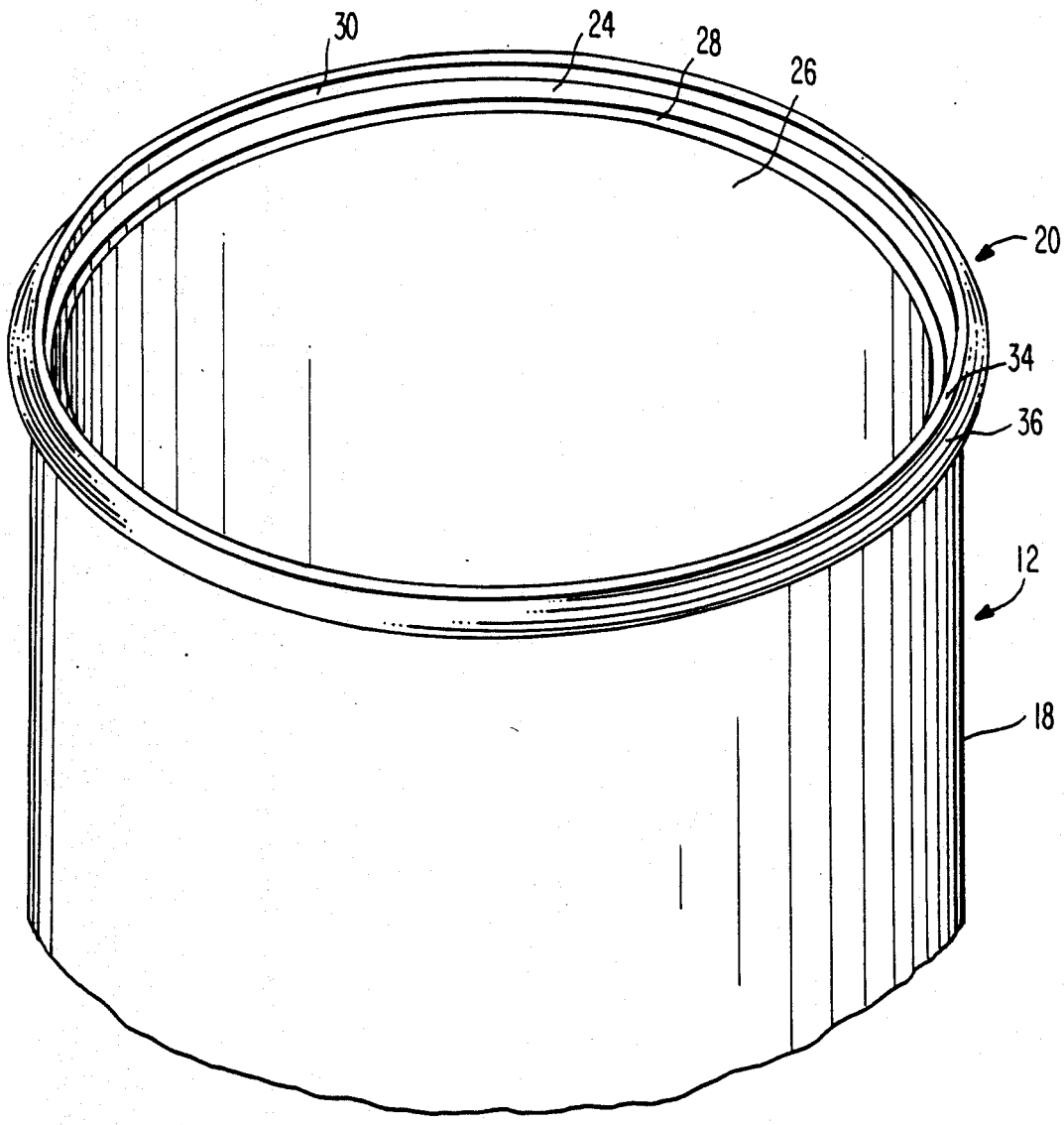
FIG. 2 is a front perspective view of an upper portion of the plastic container of the subject invention.
Figure 3:
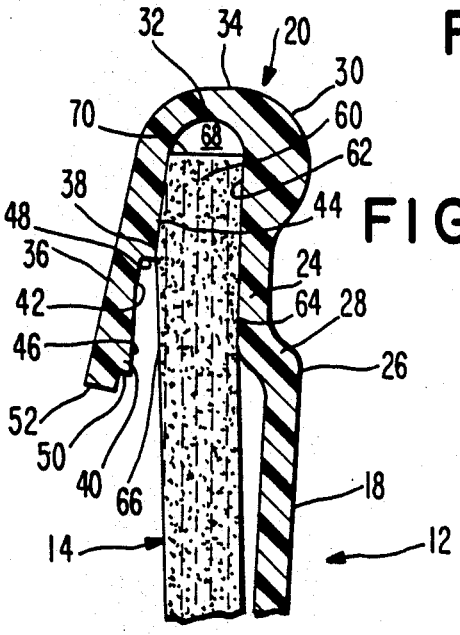
FIG. 3 is a sectional view of an upper portion of the sleeve and inner container.
Figure 4:
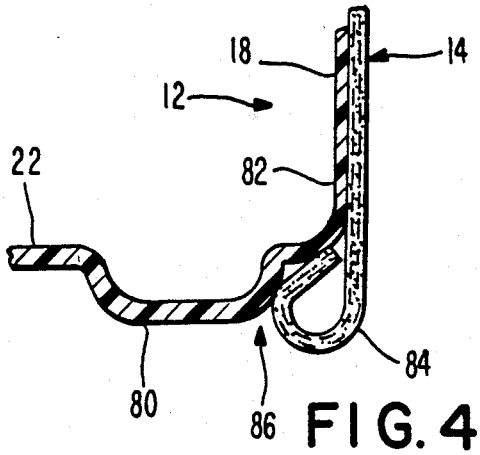
FIG. 4 is a sectional view of a lower portion of the sleeve and inner container.

As may be seen more clearly in FIGS. 2, 3, and 4, plastic inner container 12 is formed in a generally cup-like shape which includes an upstanding, generally cylindrical sidewall 18. This sidewall 18 terminates in an upper, outturned circumferential flange 20. Base 22, which is generally planar and transverse to the vertical axis of the cylindrical sidewall 18 of inner plastic container 12, is formed at the lower end of sidewall 18.

Referring particularly to FIG. 3, it will be seen that cylindrical sidewall 18 of inner plastic container 12, is formed at its upper portion with outturned flange 20. A transitional, radially outwardly directed, annular groove 24 is formed above upper portion 26 of cylindrical sidewall 18 of inner container 12. An outwardly inclined shoulder 28 joins annular groove 24 to upper portion 26 of cylindrical sidewall 18. As upper flange 20 continues upwardly from transitional annular groove 24, it is formed with an enlarged inner circumferential bead 30. This bead 30 is formed by increasing the thickness of the material used to form inner container 12. The apex 32 of flange 20 is formed with an outer or upper apex wall section 34 that is somewhat planar. From apex 32, flange 20 extends downwardly and is inclined radially outwardly as a somewhat flexible flange web 36. A pair of inwardly directed wedge rings 38 and 40 are formed on an inner surface 42 of flange web 36.

Each of these wedge rings 38, 40 includes a sloped wedging surface 44, 46 respectively, which terminates in a lower generally horizontal step 48, 50 respectively. Flange web 36 terminates in a lower free end 52 which, as may be seen in FIG. 3, is disposed generally at the same height as the inclined shoulder 28 formed at the upper portion 26 of sidewall 18.

Again referring to FIG. 3, it may be seen that flange 20 defines a closed top pocket into which an upper end 60 of cylindrical sleeve 14 is insertable. An inner surface 62 of upper sleeve end 60 bears against an outer wall portion 64 of transitional groove 24 of container 12. Similarly, an outer portion 66 of upper sleeve end 60 is located adjacent wedge rings 38 and 40 formed on inner surface 42 of flange web 36. A small air space or gap 68 may be left between the upper surface 70 of upper end 60 of sleeve 14 and the inner portion of flange apex 32. Flange web 36 is inclined outwardly at generally about 15° to the vertical and is sufficiently resilient to hold sleeve 14 in place once the sleeve has been slid up about inner container 12. The sleeve 14 is formed as a right circular cylinder but is deformed somewhat radially outwardly by the outer wall 64 of transitional groove 24.

Base 22 of inner container 12 is generally planar, as may be seen in FIG. 4, and is formed with an annular base ring 80 located just slightly radially inwardly of a lower portion 82 of sidewall 18 of inner container 12. Outer paperboard or cardboard sleeve 14 is formed, at its lower end, with an inwardly rolled rim 84 that is dimensioned to seat against the side of annular base ring 80. This cooperation between base ring 80 on inner container 12 and rolled rim 84 on outer sleeve 14 limits the upward travel of sleeve 14 on container 12 thereby insuring that the slight air gap 68 is provided. This cooperation also defines a stacking annulus, generally at 86. This annulus improves the support stability of the composite sleeved container and further aids in stacking the container 10.

Figure 5:
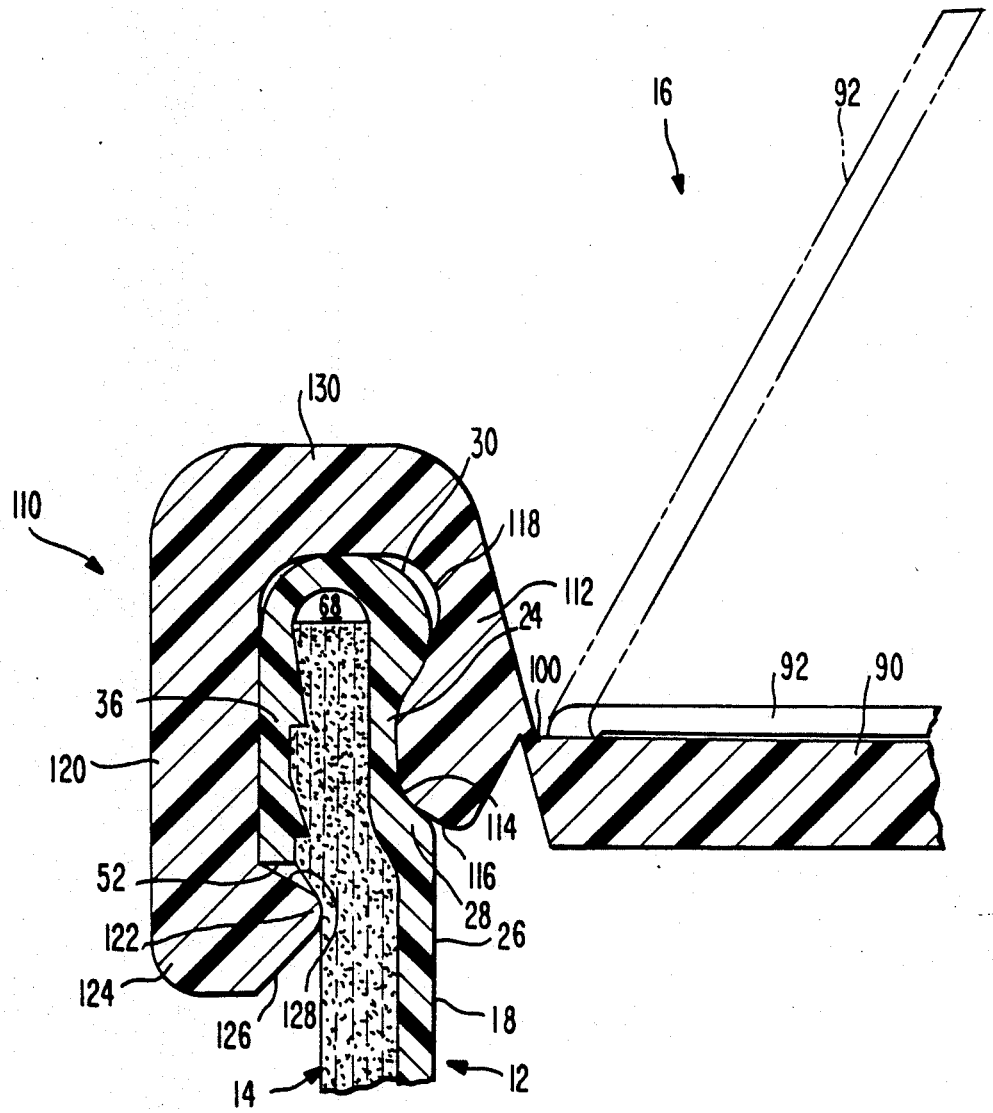
FIG. 5 is an elevation view, partly in section, of the sleeve, inner container, and closure of the present invention and taken along line V—V of FIG. 1.

Snap on closure cap or lid 16, and its cooperation with the upper portion of inner container 12 and sleeve 14 may be seen most clearly in FIG. 5. Cap or lid 16 is formed with a generally planar, central removable cover disk 90 that is provided with a pull tab 92. One or more snap tabs 94, as may be seen in FIG. 1 are used to retain the pull tab 92 in place. Pull tab 92 is attached to cover disc 90 adjacent to a line of weakening 100 which defines the outer circumference of removable cover disk 90. As may be seen in phantom line in FIG. 5, the pull tab 92 may be elevated and pulled to separate cover disk 90 along its line of weakening 100 thereby opening the container.

Snap on closure 16 is forced face down over the upper portion of inner container 12 and outer sleeve 14 after the container has been filled, and is held in place without the need for any adhesives or crimping steps. Such engagement between the closure 16 and the sleeved container 12 and 14 is facilitated by the structure of the closure cap 16 and its cooperation with the inner container and sleeve 14 in a manner as will now be discussed. As may be seen most clearly in FIG. 5, closure cap or lid 16 includes an annular clamping channel 110 which is joined to the central removable cover disk 90 by the line of weakening 100. Clamping channel 110 faces generally downwardly and is shaped generally to cooperate with the upper flange 20 of inner container 12. An inner clamping channel sidewall 112 is formed having a radially outwardly directed circumferential tongue 114. Tongue 114 is dimensioned to interfit with cooperating transitional groove 24 in the upper portion of inner container 12. When clamping channel 110 is in place, as seen in FIG. 5, a lower surface 116 of tongue 114 abuts the inclined shoulder 28 thereby limiting downward travel of closure 16. Above tongue 114, the wall thickness of inner clamping channel sidewall 112 decreases to form an annular recess 118 into which inner circumferential bead 30 is received. Thus the inner wall of clamping channel 110 and the inner surface of inner container 12 interact in two separate location; i.e. the cooperation of groove 24 and tongue 114 together with the engagement of bead 30 and annular recess 118.

An outer clamping channel sidewall 120 is provided with an inwardly directed locking lip 122 at its lower, free end 124. The length of outer clamping sidewall 120 is selected to be sufficiently greater that the length of flange web 36 so that locking lip 122 will snap into place against cylindrical paperboard or cardboard sleeve 14 just below the free end 52 of flange web 36. Locking lip 122 is formed with a gently angled lower camming surface 126 and a sharply angled upper locking surface 128 which abuts free end 52 of flange web 36 to hold the locking lip 122 in place once the gently sloped surface 126 has allowed the somewhat flexible clamping channel's outer sidewall 120 to slide down over the outer surface of flange web 36.

Inner and outer clamping channel sidewalls 112 and 120 are joined at their upper ends by an interconnecting clamping channel web 130. This web 130 has a width approximately the same as the width of the upper wall 34 of apex 32 of flange 20. The thickness of the material used for clamping channel and its resiliency, as well as the width of clamping channel web 130 and hence the spacing between clamping channel sidewalls 112 and 120 is selected so that placement of clamping channel 110 over the inner container flange 20 and the upper end of sleeve 14 positioned therewithin, will cause wedge rings 38 and 40 on flange web 36 to be forced into the paperboard, cardboard or chipboard outer sleeve 14, as is shown in FIG. 5. Similarly, locking lip 122 will snap inwardly into the outer surface 66 of the upper end 60 of sleeve 14 once locking lip 122 has passed down below the level of free end 52 of flange web 36. Any attempt to pull clamping channel up and off the inner container 12 and outer sleeve 14 will be strongly resisted by the abutment of flange web free end 52 against locking surface 128, as well as by the tongue 114 and groove 24 and bead 30 and recess 118 cooperation discussed above. This thereby assures a positive, secure attachment of closure assembly 16 to the sleeved container 12 and 14. Any leakage of the container's contents is presented by the labyrinth nature of the tongue and groove and bead and recess structure. If desired, a seal means, such as spaced sealing flanges (not shown) could also be formed on the inner surface of clamping channel web 130. Slippage of the outer sleeve 14 is resisted by the engagement of locking lip 122 and wedge rings 38 and 40 with the sleeve 14.

In use, inner containers 12 and outer sleeves 14 are fabricated using appropriate techniques. The sleeves may be suitably colored and printed, as shown somewhat schematically in FIG. 1. Each inner container 12 may then be encased with an outer sleeve 14 and the sleeved container is then filled. Alternatively, the inner container 12 may first be filled and then sleeved. The same type of inner container can be used with a variety of different products such as orange and grapefruit juice concentrates merely by use of the appropriate outer sleeve. Application of the closure cap 16 to the filled, sleeved container does not require any complex equipment or procedure since the caps or closures 16 are snap fit into place by the application of downward pressure. No sealing adhesives or crimping is required to attach the closure 16 to the sleeved container. The incorporation of the pull tab and circumferential line of weakening into the closure assembly makes a package that is much more convenient to use. The thickness of the line of weakening is such that the cover disk will be removed before a sufficient force could be applied to the closure to possibly cause the closure to start to separate from the sleeved container.

The sleeved container and closure assembly in accordance with the present invention retains the feel and appearance of the cardboard or chipboard frozen juice concentrate containers of the prior art as well as the ability of the container to be printed and colored. The inner container is inert and flexible and maintains the product in much better condition than did the prior art devices. The closure cover is easy to apply, forms a tight, dependable, non-leaking closure, and can be easily opened. Thus the sleeved container and closure assembly of the present invention is far superior to the prior art devices.

While a preferred embodiment of the sleeved container and closure assembly in accordance with the present invention has been set forth fully and completely hereinabove, it will be obvious to one of skill in the art that a number of changes in, for example the materials used for the inner container and sleeve, the sizes of the container and cooperating sleeves, the type of printing or lettering formed on the sleeve, and the like could be made without departing from the true spirit and scope of the present invention which, accordingly is to be limited only by the following claims.

We claim:

1. A sleeved container and closure assembly comprising:

an inner flexible plastic container, said inner container having a generally cylindrical upstanding sidewall and an integral bottom, an upper portion of said sidewall terminating at an inclined shoulder joined to an outwardly and downwardly directed flange through a transitional, radially outwardly directed, annular groove, said flange including a flange web having spaced wedge rings on an inner surface;

an outer cardboard sleeve, said sleeve being generally in the form of a right circular cylinder and sized to closely surround said inner flexible container, an upper end of said outer sleeve being positionable within said flange and being deformed radially outwardly by contact with an outer wall of said transitional groove, a lower end of said outer sleeve being postionable adjacent said bottom of said inner container; and a snap-fit closure having a central cover disk and an annular circumferential clamping channel, said clamping channel including an inner sidewall having a tongue receivable in said transitional groove, a lower surface of said tongue being positionable in contact with said inclined shoulder, and a spaced outer sidewall terminating in an inwardly directed locking lip, said locking lip having a sharply angled upper locking surface which is positioned below a free end of said flange web, said locking lip further contacting said radially outwardly deformed upper end of said sleeve when said closure is applied to said flange, said clamping channel having a channel width sized to compress said spaced wedge rings against an outer surface of said radially deformed upper end of said outer sleeve, said sleeve and said inner container being secured to each other as said closure is secured to said sleeve and inner container to thereby form said sleeved container and closure assembly.

2. The sleeved container and closure assembly of claim 1 wherein an enlarged inner bead is formed in said sidewall of said inner container above said groove.

3. The sleeved container and closure assembly of claim 1 wherein each of said wedge rings includes a wedging surface and a generally horizontal step.

4. The sleeved container and closure assembly of claim 1 wherein said locking lip further includes a lower camming surface.

5. The sleeved containers and closure assembly of claim 1 wherein said bottom of said inner container includes an annular base ring.

6. The sleeved container and closure assembly of claim 5 wherein said outer sleeve includes a lower rolled rim, said rolled rim being positioned adjacent said annular base ring and cooperating therewith to form a stacking annulus.

7. The sleeved container and closure assembly of claim 2 wherein said clamping channel includes an annular recess in an inner sidewall, said annular recess being sized to receive said enlarged inner bead.

8. The sleeved container and closure assembly of claim 1 wherein said central cover disk is removable and is secured to said clamping channel by a line of weakening.

9. The sleeved container and closure assembly of claim 8 wherein said removable cover disk carries a pull tab, said pull tab being secured to said cover generally adjacent said line of weakening.

* * * * *